United States Patent [19]

Shanton

[11] 4,391,850

[45] Jul. 5, 1983

[54] RECORD MATERIAL CARRYING A COLOR DEVELOPER COMPOSITION

[75] Inventor: Kenneth J. Shanton, Beaconsfield, England

[73] Assignee: The Wiggins Teape Group Limited, England

[21] Appl. No.: 272,719

[22] Filed: Jun. 11, 1981

[30] Foreign Application Priority Data

Jun. 13, 1980 [GB] United Kingdom ..... 8019369

[51] Int. Cl.[3] ..... B41M 5/16; B41M 5/18; B41M 5/22

[52] U.S. Cl. ..... 427/150; 282/27.5; 427/151; 427/201; 427/204; 427/212; 427/214; 427/217; 427/219; 428/320.4; 428/329; 428/331; 428/341; 428/342; 428/913; 428/914

[58] Field of Search ..... 282/27.5; 427/150, 151, 427/180, 191, 192, 201, 202, 204, 205, 212, 214, 217–219; 428/240, 241, 329, 331, 320.4, 320.6, 320.8, 913, 914, 340–342, 403, 404, 537

[56] References Cited

U.S. PATENT DOCUMENTS

| | | | |
|---|---|---|---|
| 3,736,285 | 5/1973 | Miller | 260/29.6 |
| 4,289,806 | 9/1981 | Sato et al. | 282/27.5 |

FOREIGN PATENT DOCUMENTS

| | | | |
|---|---|---|---|
| 44-2193 | 1/1969 | Japan | 282/27.5 |
| 1271304 | 4/1972 | United Kingdom | 282/27.5 |
| 1467003 | 3/1977 | United Kingdom | 282/27.5 |

*Primary Examiner*—Bruce H. Hess
*Attorney, Agent, or Firm*—Burns, Doane, Swecker & Mathis

[57] ABSTRACT

A color developer for use in a pressure- or heat-sensitive record material comprises a particulate amorphous hydrated silica/hydrated alumina composite in which the hydrated silica and hydrated alumina are chemically bound, in which hydrated silica predominates, in which the mean alumina content on a dried weight basis is at least 7.5%, based on the total weight of silica and alumina, and in which the surface area is below 300 $m^2g^{-1}$. The composite may be metal-modified.

8 Claims, No Drawings

RECORD MATERIAL CARRYING A COLOR DEVELOPER COMPOSITION

This invention relates to record material carrying a colour developer composition and to a process for the production of the record material. The record material may be, for example, part of a pressure-sensitive copying system or of a heat-sensitive recording system.

In one known type of pressure-sensitive copying system, usually known as a transfer system, an upper sheet is coated on its lower surface with microcapsules containing a solution of one or more colourless colour formers and a lower sheet is coated on its upper surface with a colour developing co-reactant material. A number of intermediate sheets may also be provided, each of which is coated on its lower surface with microcapsules and on its upper surface with colour developing material. Pressure exerted on the sheets by writing or typing ruptures the microcapsules, thereby releasing the colour former solution on to the colour developing material on the next lower sheet and giving rise to a chemical reaction which develops the colour of the colour former. In a variant of this system, the microcapsules are replaced by a coating in which the colour former solution is present as globules in a continuous matrix of solid material.

In another type of pressure-sensitive copying system, usually known as a self-contained or autogeneous system, microcapsules and colour developing co-reactant material are coated onto the same surface of a sheet, and writing or typing on a sheet placed above the thus-coated sheet causes the microcapsules to rupture and release the colour former, which then reacts with the colour developing material on the sheet to produce a colour.

Heat-sensitive recording systems frequently utilise the same type of reactants as those described above to produce a coloured mark, but rely on heat to convert one or both reactants from a solid state in which no reaction occurs to a liquid state which facilitates the colour-forming reaction.

The sheet material used in such systems is usually of paper, although in principle there is no limitation on the type of sheet which may be used.

Siliceous materials, of both natural and synthetic origin, have long been recognised as materials suitable as co-reactants for developing the colour of colour formers for use in record material.

Colour developing siliceous materials of natural origin include attapulgite, kaolin, bentonite and zeolite clays. Colour developing siliceous materials of synthetic origin include hydrated silicas, such as silica gel, and metal silicates, such as magnesium silicate.

U.S. Pat. No. Re 23,024, and U.S. Pat. Nos. 2,505,488, 2,699,432, 2,828,341, 2,828,342, 2,982,547, 3,540,909, and 3,540,910 are examples of disclosures of the siliceous materials just discussed. More recently, the use of silica-based co-reactant materials containing a proportion of alumina (7.5 to 28% on a dried weight basis based on the total weight of silica and alumina) has been proposed, see U.K. Pat. No. 1,467,003. The silica/alumina material disclosed in U.K. Pat. No. 1,467,003 has a surface area in the range of 300 to 800 $m^2 g^{-1}$, a mean pore diameter of 40 to 100 Å, a pore volume in the range 0.5 to 1 $cm^3 g^{-1}$ and an average particle size (as measured using a Coulter Counter) of 15 to 3 microns. The use as a co-reactant material of high surface area silica carrying a precipitated metal aluminate on its surface has also been proposed, see U.K. Pat. No. 1,271,304.

It has now been found that hydrated silica/hydrated alumina composites in which the silica predominates and the alumina content is at least 7.5% (on a dried weight basis, based on the total amount of alumina and silica) and which have a surface area of less than 300 $m^2 g^{-1}$ exhibit good colour developing properties, both as regards intensity and resistance to fading.

Accordingly, the present invention provides in a first aspect record material carrying a colour developer composition comprising a particulate amorphous hydrated silica/hydrated alumina composite in which the hydrated silica and hydrated alumina are chemically bound, in which hydrated silica predominates, and in which the mean alumina content of the composite on a dried weight basis is at least 7.5%, based on the total dry weight of silica and alumina, characterized in that the surface area of the composite is below 300 $m^2 g^{-1}$.

In a second aspect, the present invention provides a process for the production of record material carrying a particulate amorphous hydrated silica/hydrated alumina composite in which the hydrated silica and hydrated alumina are chemically bound, and in which hydrated silica predominates, comprising the steps of reacting hydrated silica and hydrated alumina together in an aqueous medium to produce a dispersion of said composite in proportions such that the mean alumina content of the resulting composite on a dried weight basis is at least 7.5%, based on the total dry weight of silica and alumina, applying a coating composition incorporating said composite to a substrate and drying the coated substrate to produce said record material, characterized in that the hydrated silica and hydrated alumina are reacted together such that the surface area of the resulting composite is below 300 $m^2 g^{-1}$.

The record sheet may carry the colour developing material as a coating, in which case it may form part of a transfer or self-contained pressure-sensitive copying system or of a heat-sensitive recording system as described above. Alternatively, however, it may carry the colour developing material as a loading. Such a loaded sheet may be used in the same manner as the coated record sheet just described, or it may be used in a sheet which also carries microencapsulated colour former solution as a loading, i.e. in a self-contained copying system.

The hydrated silica/hydrated alumina composite may be produced by reacting the hydrated silica and hydrated alumina together in any of a number of ways (it should be appreciated in this context that the hydrated silica and/or the hydrated alumina may itself be produced by precipitation at substantially the same time as the reaction between the hydrated silica and hydrated alumina takes place). These include the precipitation of hydrated alumina from aqueous solution in the presence of previously-precipitated hydrated silica, with resultant deposition of the hydrated alumina on to the hydrated silica. This is thought to result in the hydrated alumina being present in a greater proportion in a surface region of the particles of the composite than elsewhere. The previously precipitated hydrated silica used in this route may be a material produced in a separate production process, for example a commercially available precipitated silica, or it may be a material which has been precipitated just previously as an earlier step in a single process for producing the composite.

Alternative routes to the production of the composite include (a) the simultaneous precipitation of hydrated silica and hydrated alumina from the same aqueous medium i.e. the hydrated silica and hydrated alumina are reacted together as they are produced (b) the admixture of hydrated silica and recently-precipitated hydrated alumina, and (c) the treatment of previously-formed silica with aluminium oxide or hydroxide in an alkaline medium. In both route (b) and route (c) the silica may be freshly precipitated, but it need not be.

Precipitation of hydrated silica as part of any of the procedures just mentioned is conveniently carried out by treating a solution of sodium or potassium silicate with an acid, normally one of the common mineral acids such as sulphuric, hydrochloric or nitric acid.

Precipitation of hydrated alumina as part of any of the procedures just mentioned is conveniently carried out by treating a solution of a cationic aluminium salt with an alkaline material such as sodium or potassium hydroxide, although other alkaline materials may be used, for example lithium hydroxide, ammonium hydroxide or calcium hydroxide. It is normally convenient to use aluminium sulphate as the aluminium salt, but other aluminium salts may be used, for example aluminium nitrate or aluminium acetate.

When both the silica and alumina are to be precipitated simultaneously, there are a number of possible sequences of preparation steps. For example, a hydrated silica/hydrated alumina composition may be precipitated by acidifying a solution of sodium or potassium silicate to pH 7 (e.g. with sulphuric acid), adding aluminium sulphate and raising the pH with sodium or potassium hydroxide. Alternatively, an alumina-silica mixture may be obtained by mixing a solution of aluminium sulphate and sodium or potassium silicate, optionally whilst maintaining a high pH, and lowering the pH (e.g. with sulphuric acid) to bring about precipitation.

A further possibility is to precipitate hydrated silica and hydrated alumina from separate solutions and to admix the two precipitated materials whilst still fresh.

Instead of the use of a cationic aluminium salt, hydrated alumina may be precipitated from a solution of an aluminate, for example sodium or potassium aluminate, by addition of acid, e.g. sulphuric acid.

Preferably, the production of the composite by any of the foregoing routes takes place in the presence of a polymeric rheology modifier such as the sodium salt of carboxymethyl cellulose (CMC), polyethylene imine or sodium hexametaphosphate. The presence of such a material modifies the rheological properties of the hydrated silica/hydrated alumina dispersion and thus results in a more easily agitatable, pumpable and coatable composition, possibly by having a dispersing or flocculating action.

If the present material is formed by precipitation of hydrated silica in conjunction with precipitation of hydrated alumina, it is frequently advantageous to perform the precipitation in the presence of a particulate material which may function as a carrier or nucleating agent. Suitable particulate materials for this purpose include kaolin, calcium carbonate or other materials commonly used as pigments, fillers or extenders in the paper coating art, since these materials will normally be included in the final coating composition anyway.

The previously-formed hydrated silica which may be used in the preparation of the hydrated silica/hydrated alumina composite may in principle be any of the silicas which are commercially available, although it is conceivable that some materials may not be effective for some reason.

Preferably, the previously formed hydrated silica is a precipitated silica. Results obtained with two commercially-available silicas are detailed in the Examples set out hereafter, and these afford guidance as to suitable choice of material, whilst not of course obviating the need for routine experimentation and optimisation prior to manufacture of the colour developing composite.

In a preferred embodiment of the present invention, the colour developing composite is modified by the presence of one or more additional metal compounds or ions (the chemical nature of the metal modified material has not yet been fully elucidated, as discussed further hereafter). This enables substantial improvements to be achieved in the initial intensity, and fade resistance of the print obtained with so-called rapid-developing colour formers, and in reactivity towards so-called slow-developing colour formers. Categorisation of colour formers by the speed by which they bring about colour development has long been a common practice in the art. 3,3-bis(4'-dimethylaminophenyl)-6-dimethylaminophthalide (CVL) and similar lactone colour formers are typical of the rapid-developing class, in which colour formation results from cleavage of the lactone ring on contact with an acid co-reactant. 10-benzoyl-3,7-bis(-dimethylamino) phenothiazine (more commonly known as benzoyl leuco methylene blue or BLMB) and 10-benzoyl-3,7-bis(diethylamino)phenoxazine (also known as BLASB) are examples of the slow-developing class. It is generally believed that formation of a coloured species is a result of slow hydrolysis of the benzoyl group over a period of up to about two days, followed by aerial oxidation.

Other colour formers are known in the art of which the speed of development is intermediate between the so-called rapid-developing and slow-developing colour formers. This intermediate category is exemplified by spiro-bipyran colour formers which are widely disclosed in the patent literature. Modification of the present hydrated silica/hydrated alumina composite with metal compounds or ions has also been found to enhance colour developing performance with respect to these intermediate-developing colour formers.

The effect achieved by modification with metal compounds or ions depends on the particular metal involved and the particular colour former(s) being used. A wide range of metals can be used for modification, see for instance those referred to in the Examples hereafter. Copper is the preferred modifying metal.

Metal modification may conveniently be brought about by treating the hydrated silica/hydrated alumina composite, once formed, with a solution of the metal salt, for example the sulphate or nitrate. Alternatively, a solution of the metal salt may be introduced into the medium from which the hydrated alumina, and possibly also the hydrated silica, is deposited. The latter technique has in some instances been found to modify the rheological properties of the hydrated silica/hydrated alumina dispersion so as to make it more easily agitatable, pumpable and coatable. In the preferred embodiment of the process in which the hydrated alumina is precipitated from aqueous solution in the presence of previously precipitated hydrated silica, the modifying metal compound is present during the precipitation of the hydrated alumina, or is introduced as a sequential step after that reaction. This is thought to result in the modifying metal being present in a greater proportion in a surface region of the particles of the composite than elsewhere.

As previously stated, the precise nature of the species formed during metal-modification has not so far been fully elucidated, but one possibility is that a metal oxide or hydroxide is precipitated so as to be present in the alumina/silica composite. An alternative or additional possibility is that ion-exchange occurs so that metal ions are present at ion-exchange sites on the surface of the silica alumina composite.

In order to ensure that the surface area of the hydrated silica/hydrated alumina composite is below 300 $m^2g^{-1}$ in the case of a precipitated silica, it is necessary to avoid many of the steps which are commonly used in the commercial manufacture of silica by precipitation from sodium silicate (higher surface areas are normally needed for most commercial applications of silica). These steps typically include hot water storage of precipitated silica and subsequent roasting of the precipitate when separated from the aqueous medium in which it was formed.

However, if a previously-formed silica is used as the starting material, it may have a surface area above 300 $m^2g^{-1}$, and yet still afford a silica/alumina composite having a surface area below 300 $m^2g^{-1}$, since the effect of aluminium deposition is to lower the surface area. A similar lowering of surface area is observed to result from metal modification.

It is found that too low a surface area tends to give a material of insufficient reactivity for good colour developing properties. In general therefore the hydrated silica/hydrated alumina composite should have a surface area not lower than about 100 $m^2g^{-1}$.

The hydrated silica/hydrated alumina composite is normally used in a composition also containing a binder (which may be wholly or in part constituted by the CMC preferably used as a rheology modifier during the preparation of the colour developing material) and a filler or extender, which typically is kaolin, calcium carbonate or a synthetic paper coating pigment, for example a urea formaldehyde resin pigment.

The filler or extender may be wholly or in part constituted by the particulate material which may be used during the preparation of the hydrated silica/hydrated alumina composite. The pH of the coating composition influences the subsequent colour developing performance of the composition, and also its viscosity, which is significant in terms of the ease with which the composition may be coated on to paper or other sheet material. The preferred pH for the coating composition is within the range 5 to 9.5, and is preferably around 7. Sodium hydroxide is conveniently used for pH adjustment, but other alkaline materials may be used, for example potassium hydroxide, lithium hydroxide, calcium hydroxide, ammonium hydroxide, sodium silicate, or potassium silicate.

The hydrated silica/hydrated alumina composite may be used as the only colour developing material in a colour developing composition, or it may be used together with other colour developing materials, e.g. an acid-washed dioctahedral montmorillonite clay, a phenolic resin, or a salicylic acid derivative. Mixture with acid-washed dioctahedral montmorillonite clay, for example in equal amounts on a weight basis, has been found to offer particular advantage.

It is usually desirable to treat the hydrated silica/hydrated alumina composite in order to break up any aggregates which have formed. This is especially true in the case of a composite produced by a process in which both the hydrated silica and hydrated alumina are precipitated. The preferred treatment is ball-milling, and it may be carried out before or after fillers or additional colour developing materials are added (if they are added at all). The preferred final mean volume particle size is desirably about 3.0 to 3.5 $\mu$m. Whilst improvements in reactivity may be achievable below this size, they tend to be counteracted by disadvantageously high viscosities. A suitable instrument for measurement of particle size is a Coulter Counter with a 50 $\mu$m tube.

At least in the case of hydrated silica/hydrated alumina composites produced by a process in which both the hydrated silica and hydrated alumina are precipitated, it has been found that enhanced colour developing performance tends to result if the freshly prepared composite is left in dispersion for a few hours, for example overnight, before being coated on to a suitable substrate. The reasons for this have not been fully elucidated.

It has been found that the reactivity of the composite does not significantly decline progressively with time, which is a drawback of a number of widely used colour developing materials. The effect of such decline is that the intensity of print obtained using a freshly-manumanufactured colour developing sheet is considerably greater than that obtained with the same sheet a few days later, and this intensity is in turn considerably greater than that obtained with the same sheet a few months later. This is a serious drawback, since the colour developer sheet is frequently not used until many months after it has been manufactured. This is because the chain of distribution is frequently from the paper manufacturer to a wholesaler to a printer and thence to the end user. This means that in order to guarantee that the intensity of print will be acceptable to the end user many months after the paper has been manufactured, the manufacturer must use a greater amount of reactive material in the production of the colour developing sheets than is needed to produce a print on those sheets immediately after manufacture. Since the colour developing material is expensive, this adds significantly to the cost of pressure-sensitive copying systems. The fact that the hydrated silica/hydrated alumina composite used in the present recording material reduces or eliminates this problem is thus a major benefit.

The invention will now be illustrated by the following Examples, in which all percentages are by weight:

EXAMPLE 1

This illustrates the production of copper-modified hydrated silica/hydrated alumina composites by a method in which both the silica and the alumina are precipitated.

1.2 g of CMC (FF5 supplied by Finnfix of Finland) were dissolved in 90 g deionised water over a period of 15 minutes with stirring. Xg of sodium silicate (48% solids content) were then added (X being as set out below) with continued stirring. When the sodium silicate had been dispersed, Yg (amount detailed later) of aluminium sulphate, $Al_2(SO_4)_3$, $16H_2O$ were added and the mixture was stirred for 15 minutes, 20 g of 20% w/w copper sulphate ($CuSO_4$, $5H_2O$) solution were added and stirring was continued for a further hour. Sulphuric acid (40% w/w) was then added dropwise over a period of at least half an hour until pH 7.0 was reached. Addition of sulphuric acid brings about precipitation, which results in mix thickening. In order to avoid gelling, the addition of sulphuric acid must be stopped when thickening commences, and continued only after stirring for a period sufficient to allow equilibration to occur. 16.0 g of kaolin (Dinkie A supplied by English China Clays Ltd.) were then added when acid addition was complete, and the mixture was stirred for a further half-hour. 10 g of styrene-butadiene latex (Dow 675 supplied by Dow Chemical at 50% solids) were then added, and the pH was re-adjusted to 7.0. The mixture was then ball-milled for 30 minutes using a one-liter ball mill. Sufficient water was then added to lower the viscosity of the mixture to a value suitable for coating using a laboratory Meyer bar coater. The mixture was then coated on to paper at a nominal coat weight of 8 $gm^{-2}$, and the coated sheet was then dried and calendered and then subjected to calender intensity and fade resistance tests to assess its performance as a colour developing material.

The procedure was carried out six times in all (including a comparison with no aluminium sulphate) and the values for Xg, Yg and the alumina content, on a dried weight basis based on the total weight of silica and alumina, was as follows:

| Xg | Yg | % $Al_2O_3$ |
|---|---|---|
| 53 | 0 | 0 |
| 33 | 10 | 13.3 |
| 28 | 12.5 | 18.6 |
| 23 | 15.0 | 24.8 |
| 18 | 18.0 | 33.0 |
| 13 | 20 | 43.9 |

The calender intensity test involved superimposing a strip of paper coated with encapsulated colour former solution on a strip of the coated paper under test, passing the superimposed strips through a laboratory calender to rupture the capsules and thereby produce a colour on the test strip, measuring the reflectance of the coloured strip (I) and expressing the result (I/Io) as a percentage of the reflectance of an unused control strip (Io). Thus the lower the calender intensity value (I/Io) the more intense the developed colour. The calender intensity tests were done with two different papers, designated hereafter as Papers A and B. Paper A employed a commercially used blue colour former blend containing, inter alia, CVL as a rapid-developing colour former and BLASB as a slow-developing colour former. Paper B employed a commercially used black colour former blend also including CVL and BLASB.

The reflectance measurements were done both two minutes after calendering and forty-eight hours after calendering, the sample being kept in the dark in the interim. The colour developed after two minutes is primarily due to the rapid-developing colour formers, whereas the colour after forty-eight hours derives also from the slow-developing colour formers, (fading of the colour from the rapid-developing colour formers also influences the intensity achieved).

The fading test involved positioning the developed strips (after forty-eight hours development) in a cabinet in which were an array of daylight fluorescent stri-plamps. This is thought to simulate, in accelerated form, the fading which a print might undergo under normal conditions of use. After exposure for the desired time, measurements were made as described with reference to the calender intensity test, and the results were expressed in the same way.

The results obtained for Paper A were as follows:

| Test Conditions | % of $Al_2O_3$ Intensity (I/Io) 13.3 | 18.6 | 24.8 | 33.0 | 43.9 | 0 |
|---|---|---|---|---|---|---|
| 2 min. development | 44.0 | 47.0 | 53.0 | 59.8 | 62.9 | 52.4 |
| 48 hour development | 39.0 | 42.1 | 45.0 | 45.0 | 58.0 | 43.9 |
| 16 hour fade | 54.6 | 56.3 | 59.6 | 63.5 | 72.5 | 65.0 |

The results obtained for Paper B were as follows:

| Test Conditions | % of $Al_2O_3$ Intensity (I/Io) 13.3 | 18.6 | 24.8 | 33.0 | 43.9 | 0 |
|---|---|---|---|---|---|---|
| 2 min. development | 51.0 | — | 56.2 | — | 57.3 | 56.2 |
| 48 hour development | 44.0 | — | 47.3 | — | 50.0 | 50.2 |
| 16 hour fade | 59.7 | — | 63.0 | — | 66.7 | 68.0 |

EXAMPLE 2

This illustrates the production of hydrated silica/hydrated alumina composites by a method in which hydrated alumina is precipitated on to previously-formed silica (Gasil 35 supplied by Joseph Crosfield & Sons Ltd. of Warrington, England).

1.2 g of CMC (FF5) were dissolved in 110 g of deionized water over a period of 15 minutes with stirring. 14.0 g silica were added followed by 9.64 g of aluminium sulphate, $Al_2(SO_4)_3 \cdot 16H_2O$. The mixture was left stirring for more than an hour. 11 g of kaolin (Dinkie A) were then added and the mixture was stirred for a further half-hour. The pH of the mixture was then adjusted to 7.0 by the addition of sodium hydroxide, after which 10.0 g of a styrene-butadiene latex binder were added (Dow 675). The pH was then re-adjusted to 7.0. Sufficient water was then added to lower the viscosity of the mixture to a value suitable for coating using a laboratory Meyer bar coater. The mixture was then coated on to paper at a nominal coat weight of 8 $gm^{-2}$, and the coated sheet was then dried and calendered, and then subjected to calender intensity and fade resistance tests to assess its performance as a colour developing material.

The alumina content of the resulting material was 10% on a dried weight basis, based on the total weight of alumina and silica.

The procedure was then twice repeated but using in the first case 105 g water, 12.44 g silica and 19.3 g aluminium sulphate and in the second case 95 g water, 9.33 g silica and 38.5 g aluminium sulphate instead of the quantities of those materials described above (the quantities of the remaining materials used remained the same). The alumina contents of the resulting materials were 20% and 40% respectively, on the same basis as before. The procedure was also repeated without using any aluminium sulphate, for comparison purposes.

The resulting paper was subjected to calender intensity and fade resistance tests with Paper A.

The results were as follows:

| Test Conditions | % of alumina Intensity (I/Io) 10% | 20% | 40% | 0% |
|---|---|---|---|---|
| 2 min. development | 44.7 | 45.8 | 51.8 | 50.0 |
| 48 hour development | 36.6 | 39.0 | 42.8 | 44.2 |
| 1 hour fade | 34.9 | 38.2 | 41.2 | 45.0 |

-continued

| Test Conditions | % of alumina Intensity (I/Io) 10% | 20% | 40% | 0% |
|---|---|---|---|---|
| 3 hour fade | 35.4 | 39.4 | 43.6 | 48.8 |
| 5 hour fade | 38.0 | 42.4 | 47.6 | 52.9 |
| 10 hour fade | 44.2 | 48.7 | 58.2 | 60.1 |
| 15 hour fade | 50.0 | 55.9 | 66.3 | 65.8 |
| 30 hour fade | 59.9 | 66.2 | 73.0 | 72.3 |
| 50 hour fade | 68.4 | 73.9 | 74.2 | 74.4 |

A parallel series of experiments was then carried out to enable the surface area of the composites to be measured. In these experiments, the quantities of water, silica and aluminium sulphate used were as set out above, but no CMC was used, and the procedure was terminated in each case before the addition of kaolin and latex (the presence of CMC and latex tends to cause the particles of composite to become bound to one another, which would result in the true surface area of the composite becoming masked). After the stage of stirring for more than an hour, the dispersion was filtered, washed twice with de-ionized water, dried at 105°-110° C. and subjected to surface area measurement by the B.E.T. method. The results were as follows.

| % alumina | surface area ($m^2g^{-1}$) |
|---|---|
| 10 | 252 |
| 20 | 244 |
| 40 | 171 |
| 0 | 315 |

EXAMPLE 3

This illustrates the production of a copper-modified hydrated silica/hydrated alumina composite by a method similar to that used in Example 2.

The procedure was as described in Example 2 (using all three aluminium sulphate quantities) except that after the aluminium sulphate had been added and the mixture stirred for an hour, 18 g of copper sulphate solution, $CuSO_4.5H_2O$ (15% w/w) were added and the mixture was stirred for a further hour before the addition of kaolin.

The results obtained (with Paper A) were as follows:

| Test Conditions | % of alumina Intensity (I/Io) 10% | 20% | 40% | 0% |
|---|---|---|---|---|
| 2 min. development | 43.8 | 44.9 | 56.1 | 47.6 |
| 48 hour development | 34.9 | 37.0 | 45.5 | 39.1 |
| 1 hour fade | 34.6 | 36.1 | 42.1 | 44.2 |
| 3 hour fade | 35.6 | 37.3 | 44.5 | 49.5 |
| 5 hour fade | 37.1 | 41.9 | 52.5 | 54.7 |
| 10 hour fade | 42.4 | 48.7 | 59.2 | 61.1 |
| 15 hour fade | 49.5 | 55.9 | 63.2 | 65.7 |
| 30 hour fade | 59.2 | 64.6 | 70.5 | 71.0 |
| 50 hour fade | 65.9 | 71.3 | 76.5 | 76.8 |

The copper content of the composite, calculated as cupric oxide on a dried weight basis, based on the total weight of silica, alumina and cupric oxide, was 5.23% for the 10 and 20% alumina composites, and 4.40% for the 40% alumina composite.

EXAMPLE 4

This illustrates the use of a range of different metal compounds for modification of a hydrated silica/hydrated alumina composite.

1.2 g of CMC (FF5) were dissolved in 90 g de-ionized water over a period of 15 minutes with stirring. 12.5 g of silica (Gasil 35) were added followed by 48.3 g of 40% w/w aluminium sulphate, $Al_2(SO_4)_3$, $16H_2O$ solution. The mixture was stirred for an hour and Xg of metal salt Y were added. The mixture was stirred for a further hour, after which 11.0 g kaolin were added. The pH was then adjusted to 7.0 using sodium hydroxide, after which 10.0 g of latex were added (Dow 675). The pH was then re-adjusted to 7.0. Sufficient water was then added to lower the viscosity of the mixture to a value suitable for coating using a laboratory Meyer bar coater, and the mixture was then coated on to paper at a nominal coat weight of 8 $gm^{-2}$. The coated sheet was dried and calendered and subjected to calender intensity tests.

The metal salt Y and the quantities Xg used were as follows:

| Y | Xg |
|---|---|
| Magnesium sulphate, $MgSO_4$ | 1.30 |
| Nickel sulphate, $NiSO_4.6H_2O$ | 2.84 |
| Zinc sulphate $ZnSO_4.7H_2O$ | 3.10 |
| Zirconyl chloride $ZrOCl_2.8H_2O$ | 3.48 |
| Cobalt sulphate $CoSO_4$, $7H_2O$ | 3.03 |
| Calcium sulphate $CaSO_4$ | 1.47 |

The procedure was then repeated, but without metal salt addition, in order to provide a control. 105 g de-ionised water was used rather than 90 g.

The results obtained were as follows.

| Y | (I/Io) 2 min | 48 hour |
|---|---|---|
| Magnesium sulphate | 41.7 | 36.6 |
| Nickel sulphate | 41.2 | 35.3 |
| Zinc sulphate | 42.1 | 36.2 |
| Zirconyl chloride | 42.4 | 37.5 |
| Cobalt sulphate | 43.4 | 36.5 |
| Calcium sulphate | 42.8 | 36.8 |
| Control | 45.8 | 39.0 |

The mean alumina content of the hydrated silica/hydrated alumina composite was 20% by weight (before metal modification).

EXAMPLE 5

This illustrates the production of hydrated silica/hydrated alumina composites by a method in which both the silica and alumina are precipitated, but in which no modification with metal compounds or ions is carried out.

Xg of CMC (FF5) was dissolved in 280.0 g of di-ionised water over a period of 15 minutes with stirring. 188.0 g of sodium silicate solution (48% solids content) were then added with continued stirring. When the sodium silicate had been dispersed, Yg of 40% w/w solution of aluminium sulphate, $Al_2(SO_4)_3.16H_2O$ were added, and the mixture was stirred for more than an hour. Sulphuric acid (40% w/w) was then added dropwise, as described in Example 1, until pH 7.0 was reached. The mixture was then ball milled for 30 minutes. 44 g of kaolin (Dinkie A) were then added and the mixture was stirred for more than an hour. 40.0 g of latex (Dow 675) were then added and the pH was re-adjusted to 7.0. The mixture was then coated on to paper as described in Example 1. The resulting paper was then subjected to calender intensity and fade tests, using Paper A.

The procedure was carried out twice, the values of X and Y, and the resulting alumina content on a dried weight basis, based on the total weight of alumina and silica, being as follows:

| X | Y | Alumina Content |
|---|---|---|
| 2.4 g | 100 g | 9.8% |
| 4.8 g | 125 g | 11.9% |

The procedure was then repeated for comparison purposes using no aluminium sulphate (4.8 g CMC being used).

The results obtained were as follows:

| Test Conditions | % $Al_2O_3$ Intensity (I/Io) | | |
|---|---|---|---|
| | 9.8% | 11.9% | 0% |
| 2 min. development | 45.9 | 46.4 | 52.0 |
| 48 hour development | 40.1 | 41.8 | 45.0 |
| 16 hour fade | 61.5 | 63.5 | 68.4 |

EXAMPLE 6

This illustrates the production of copper-modified hydrated silica/hydrated alumina composites by a process in which both the silica and the alumina are precipitated, but in which the relative proportions of materials used differ from those of Example 1.

The procedure employed was as described in Example 5, except that after the aluminium sulphate solution had been added and the mixture stirred for 15 minutes, 96.0 g of 20% w/w copper sulphate $CuSO_4.5H_2O$ solution were added and stirring was continued for a further hour before the dropwise addition of the sulphuric acid.

The results obtained, using Paper A, were as follows:

| Test Conditions | % $Al_2O_3$ Intensity (I/Io) | | |
|---|---|---|---|
| | 9.8% | 11.9% | 0% |
| 2 min. development | 44.7 | 46.4 | 49.3 |
| 48 hour development | 37.7 | 39.0 | 42.7 |
| 16 hour fade | 52.7 | 53.0 | 62.8 |

The copper contents of the composites, on the same basis as in Example 3 were 8.41% and 6.12% for the 9.8% and 11.9% alumina composites respectively.

EXAMPLE 7

This illustrates the production of hydrated silica/hydrated alumina composites using a different commercially available silica, namely that supplied by Degussa as FK 310, in place of the Gasil 35 used in previous Examples.

The procedure followed was as described in Example 2 for the production of 20% and 40% alumina materials, except that FK 310 was used as a weight for weight substitute for Gasil 35. A control with no aluminium sulphate, and surface area determinations were also carried out as described in Example 2.

The results of testing with Paper A were:

| Test Conditions | % alumina Intensity (I/Io) | | |
|---|---|---|---|
| | 20% | 40% | 0% |
| 2 min. development | 43.0 | 45.3 | 50.3 |
| 48 hour development | 35.0 | 36.4 | 40.6 |
| 15 hour fade | 57.5 | 59.4 | 70.1 |

The results of testing with Paper B were:

| Test Conditions | % alumina Intensity (I/Io) | | |
|---|---|---|---|
| | 20% | 40% | 0% |
| 2 min. development | 51.0 | 52.4 | 60.3 |
| 48 hour development | 43.8 | 44.6 | 44.5 |
| 15 hour fade | 55.6 | 58.6 | 69.6 |

The results of surface area testing were:

| % alumina | surface area ($m^2g^{-1}$) |
|---|---|
| 20 | 212 |
| 40 | 129 |
| 0 | 523 |

EXAMPLE 8

This illustrates the production of a composite which is copper-modified but is otherwise similar to that described in Example 7.

The procedure followed was as described in Example 3 for the the production of a 20% alumina composite, except that FK 310 was used as a weight for weight substitute for Gasil 35. A surface area determination was also carried out, as described in Example 2.

The results of testing with Papers A and B were:

| Test Conditions | Intensity (I/Io) | |
|---|---|---|
| | Paper A | Paper B |
| 2 min. development | 45.5 | 51.0 |
| 48 hour development | 35.8 | 42.7 |
| 15 hour fade | 61.1 | 57.2 |

EXAMPLE 9

This demonstrates that CMC or another polymeric material need not be present during the production of the hydrated silica/hydrated alumina composite.

94 g of 48% w/w sodium silicate solution were dispersed with stirring in 140 g de-ionized water. 83 g of 25% w/w solution of aluminium sulphate, $Al_2(SO_4)_3.16H_2O$ were added and the mixture was stirred for 15 minutes. 56 g of 25% w/w solution of copper sulphate, $CuSO_4.5H_2O$ were added and stirring was continued for a further 10 minutes. Sulphuric acid was then added over a period of about ½ hour, observing the procedure described in previous examples, so as to give a pH of 7.0. 20 g of kaolin were then added, and the resulting dispersion was ball-milled overnight. 20 g of styrene-butadiene latex were then added and the pH was re-adjusted to 7.0 (if necessary). The resultant mixture was diluted with sufficient water to make it suitable for coating by means of a Meyer bar laboratory coater, and coated on to paper at a nominal coat weight of 8 $gm^{-2}$. The coated sheet was then dried and calendered and subjected to calender intensity and fade resistance tests. The two minute development value of ($I/I_o$) was 46, the 48 hour development value was 39, and the value after 15 hours fading was 55. These values are comparable to those obtained in other Examples, from which it can be concluded that the presence of a polymeric material is not essential to the production of an effective colour developing composite. The tests were done with Paper A.

EXAMPLE 10

2.4 g of CMC were dissolved in 175 g of de-ionized water over a period of 15 minutes with stirring. 94 g of 48% w/w sodium silicate solution were then added, with continued stirring, followed by 51.5 g of aluminium sulphate, $Al_2(SO_4)_3.16H_2O$. When this was dissolved, the pH was adjusted to 7, and stirring was continued for a further hour. The mixture was then ball milled for 45 minutes, after which a sample was extracted and subjected to a surface area determination by the B.E.T. method. The result was a value of 158 $m^2g^{-1}$. The alumina content of the composite was 10%, on a dried weight basis, based on the total weight of silica and alumina.

The procedure was then repeated, but using 115.8 g aluminium sulphate, $Al_2(SO_4)_3.16H_2O$ instead of the 51.5 g used previously, so as to give a 20% alumina content (on the same basis as before). The surface area was 179 $m^2g^{-1}$. 255.5 g of each mixture was taken from the ball-milling vessel and 15 g of styrene-butadiene latex (Dow 675) were added in each case. Each mixture was diluted with sufficient water to make it coatable by means of a laboratory Meyer bar coater, and was coated on to paper at a coat weight of 8 $gm^{-2}$. The resulting papers had 2 minute values for ($I/I_o$) for Paper A of 44.9 and 47.2 for 10% and 20% alumina respectively.

EXAMPLE 11

This demonstrates the suitability of the composite for use in a heat-sensitive record material.

90 g of silica (Gasil 35) was dispersed in 700 g of de-ionized water with stirring and 143 g of 40% w/w solution of aluminium sulphate, $Al_2(SO_4)_3.16H_2O$ was added. The pH was adjusted to 7 and the mixture was stirred for an hour after which 25 g of 25% w/w solution of copper sulphate was added. The pH was then re-adjusted to 7 and stirring was continued for a further two hours. The suspended solid material was then filtered off, washed thoroughly with de-ionized water, and dried in a fluid-bed dryer.

20 g of the composite were mixed with 48 g of stearamide wax and ground in a mortar and pestle. 45 g of de-ionized water and 60 g of 10% w/w poly(vinyl alcohol) solution (Gohsenol GL05) were added and the mixture was ball milled overnight. A further 95 g of 10% w/w poly(vinyl alcohol) solution were then added, together with 32 g de-ionized water.

In a separate procedure, 22 g of a black colour former (2'-anilino-6'-dimethylamino-3'-methylfluoran) were mixed with 42 g de-ionized water and 100 g of 10% w/w poly(vinyl alcohol) solution, and the mixture was ball-milled overnight.

The suspensions resulting from the above procedures were then mixed and coated on to paper by means of a laboratory Meyer bar coater at a nominal coat weight of 8 $gm^{-2}$. The paper was then dried.

On subjecting the coated surface to heat, a black coloration was obtained.

EXAMPLE 12

This illustrates the production of a composite by a process in which hydrated silica was precipitated and then hydrated alumina was precipitated on to it.

4.8 g of CMC was dissolved in 280 g de-ionized water over a period of 15 minutes with stirring. 190.4 g of 48% w/w sodium silicate solution and 40% w/w sulphuric acid were slowly added dropwise observing the precautions described in earlier Examples. 402.6 g of 40% w/w solution of aluminium sulphate were then added with stirring which was continued for an hour after the aluminium sulphate addition had finished. The pH was then adjusted to 7 with sodium hydroxide solution. A sample of the mixture was then removed, filtered, washed and subjected to a surface area determination by the B.E.T. method. The result was a value of 158 $m^2g^{-1}$. The alumina content of the composite was 30% on a dried weight (basis, based on the total weight of silica and alumina.

The procedure was then repeated, but using 609 g of 40% w/w aluminium sulphate solution, so as to give an alumina content of 40%. The surface area was 115 $m^2g^{-1}$.

Both mixes were diluted and coated on to paper as described in previous Examples. When used in a pressure-sensitive copying couplet with Paper A, a clear blue image was obtained.

I claim:

1. A process for the production of record material carrying a particulate amorphous hydrated silica/hydrated alumina composite comprising:

(a) preparing an aqueous mixture comprising dispersed, precipitated hydrated silica and an aluminum salt;

(b) precipitating hydrated alumina from the aqueous mixture in the presence of the dispersed, precipitated hydrated silica thereby yielding an amorphous hydrated silica/hydrated alumina composite having a mean alumina content of at least 7.5% on a dry weight basis of the total weight of silica and alumina wherein the hydrated alumina is proportionally greater in the surface region of the composite and wherein the surface area of the composite is less than 300 $m^2g^{-1}$;

(c) applying a coating composition incorporating said composite to a substrate; and (d) drying the coated substrate to produce record material.

2. The process of claim 1 wherein the hydrated alumina is precipitated in the presence of a polymeric rheology modifier.

3. The process of claim 2 wherein the rheology modifier is carboxymethyl cellulose.

4. The process of claim 1 or 2 wherein the hydrated alumina is precipitated in the presence of a particulate material.

5. The process of claim 4 wherein the particulate material is kaolin.

6. The process of claim 1 wherein prior to coating the substrate, the amorphous hydrated silica/hydrated alumina composite is ball milled until the mean volume particle size is from about 3.0 to about 3.5 μm.

7. The process of claim 1 wherein a modifying metal compound is present during the precipitation of the hydrated alumina or is introduced as a sequential step after said precipitation thereby yielding metal modification of the hydrated silica/hydrated alumina composite.

8. Record material produced by the process of claim 1 or 2.

* * * * *